United States Patent [19]

Pearo

[11] Patent Number: 4,555,044

[45] Date of Patent: Nov. 26, 1985

[54] TAMPER-PROOF PILL DISPENSER

[76] Inventor: John M. Pearo, 7653 S. Arbory La., Laurel, Md. 20707

[21] Appl. No.: 521,340

[22] Filed: Aug. 8, 1983

[51] Int. Cl.[4] ..... B65D 83/04

[52] U.S. Cl. ..... 221/19; 222/147; 206/538; 221/82

[58] Field of Search ..... 206/534, 538, 539; 215/14, 263; 222/147, 503, 505; 221/2, 5, 6, 17–19, 82, 152, 154, 69, 76, 86; 192/138; 74/526

[56] References Cited

U.S. PATENT DOCUMENTS

| | | | |
|---|---|---|---|
| 2,368,836 | 2/1945 | Holwick | 222/147 X |
| 4,128,188 | 12/1978 | White | 221/91 |
| 4,165,709 | 8/1979 | Studer | 221/5 |

FOREIGN PATENT DOCUMENTS

| | | | |
|---|---|---|---|
| 269942 | 8/1964 | Australia | 206/534 |

*Primary Examiner*—Joseph J. Rolla

*Assistant Examiner*—Michael S. Huppert

[57] ABSTRACT

A tamper-proof pill dispenser consisting of a circular base, a circular cover, a retaining member and two pawl springs, with pills being housed into a plurality of pill seating depressions located into the top surface of the base, and the cover having a dispensing hole located to line up with the pill seating depressions in the base. The pawl springs are located between the base and cover. One pawl spring working with a plurality of sawtooth notches allows one way rotation of the cover with the dispensing hole stopping over each pill seating depression. After the cover rotates over the last pill seating depression the other pawl spring snaps into a notch preventing the cover from any further rotation. The dispenser is permanently sealed by the retaining member which is mounted above the cover. Pills are dispensed from the dispenser by rotating the dispensing hole to register with the next in series pill, and then by turning the dispenser upside down the pill in register drops through the dispensing hole.

8 Claims, 5 Drawing Figures

TAMPER-PROOF PILL DISPENSER

TECHNICAL FIELD

The present invention relates to tamper-proof dispensers and more particularly to tamper-proof dispensers for housing and dispensing pills, with said dispensers manufactured so that after said dispenser is sealed at its place of manufacture the contents of said dispenser can not be altered without obvious evidence of tampering.

As stated in this application the present invention is referred to as a "tamper-proof pill dispenser", with the word "pill" meaning any drug in the form of pills, tablets, capsules and the like.

BACKGROUND OF THE INVENTION

Tampering with drugs has become a major problem for the drug industry. Between Sept. 30 and Oct. 2, 1982 seven deaths were reported in the suburbs of Chicago when Extra-Strength Tylenol capsules were laced with potassium cyanide. This tragedy forced the manufacturer, NcNeil Consumer Products Co., to recall 31 million bottles of over-the-counter pain relievers and the company estimated the total cost resulting from this crisis to have been $100 million.

Pill dispensers are presently manufactured that are designed to dispense pills one at a time through a dispensing hole which is located in a cover member. The cover is only permitted to rotate in one direction over a base member which houses the pills. The base houses each pill in a seating depression with each seating depression centered at the same distance from center point of dispenser as the dispensing hole in the cover. As the dispensing hole is rotated over a pill the pill can be dispensed from the dispenser. U.S. Pat. No. 3,895,737 fits ito this category, and to a lesser extent U.S. Pat. No. 3,355,067 claims 4 & 5. However, to be tamper-proof the one way rotation of the cover must be limited to only one pass over each pill location. If the cover is permitted free rotation in one direction without a means for locking the cover after the dispensing hole makes one pass over the pills the dispenser can be emptied and refilled over and over again and would therefore be a hazard as a possible tampered with pill dispenser.

SUMMARY OF THE INVENTION

To overcome the possibility of purchasing over-the-counter pills that may have been tampered with the present invention is designed so that after said dispenser is loaded with pills and sealed at its manufacturing plant it will only be possible to remove pills from said dispenser. After all the pills in said dispenser have been used up said dispenser can not be opened and filled up again without permanently damaging said dispenser.

The principal object of the invention is to provide a tamper-proof pill dispenser which will protect each pill housed in said dispenser from the time of its manufacture until the time that pill is to be used. To achieve this the pills are positioned in a sequential order, located into a plurality of seating depressions arranged in a circular series in the base of said dispenser. A clear plastic cover is placed over the pills and said dispenser is sealed at its manufacturing plant by permanently adhering a retaining member directly above the cover. Pills can be seen from outside said dispenser and pills can only be removed when a dispensing hole, which is located in the cover is rotated over each pill seating depression. A first pawl spring is located between the base and the cover and a plurality of first sawtooth notches are located in the underside of the cover. The first pawl spring working into the first sawtooth notches permit cover to rotate in one direction only. The first pawl spring, the first sawtooth notches and the dispensing hole in the cover are all located so that each time the first pawl spring snaps into one of the first sawtooth notches the dispensing hole in the cover will be in register with a pill seating depression so that the pill can be dispensed through the dispensing hole. A second sawtooth notch is located into the outside perimeter wall of the cover, a third notch is located into the inside perimeter wall of the base. A second pawl spring is held in the third notch. The second pawl spring is compressed into the third notch by the outer perimeter wall of the cover. The second sawtooth notch, and the spring action of the second pawl spring work in opposition to the first sawtooth notches and the first pawl spring and are so arranged so that after the dispensing hole in the cover is aligned with the last pill seating depression the second pawl spring and the second sawtooth notch wil snap together to lock the cover from any further movement. In summary a base member with its pill seating depressions, a cover member with a dispensing hole, a plurality of notches, two pawl springs and a retaining member comprise a tamper-proof pill dispenser that will only dispense the pills originally loaded into said dispenser in a sequential order, one pill at a time, with cover rotation limited to one direction and limited still further to only one pass over each pill in said dispenser.

A further object of the invention is to position the pills, the pawl springs and the sawtooth notches between the lowest recessed top surface of the base and the bottom surface of the retaining member, so that after the pills and all the parts of said dispenser have been assembled, and the retaining member has been permanently mounted on top of said dispenser said dispenser wil be completely sealed, so that the pills can not be touched until the dispensing hole in the cover is rotated over each pill location and the pawl springs which govern the rotation of the cover will be inaccessible for any means of resetting or any other such tampering action.

Other objects and advantages of the invention will become better understood hereinafter from a consideration of the specification with reference to the accompanying drawings forming part thereof, and in which like numerals correspond to like parts throughout the several views of the invention, and wherein:

DESCRIPTION OF PREFERRED EMBODIMENT

Figure 1:
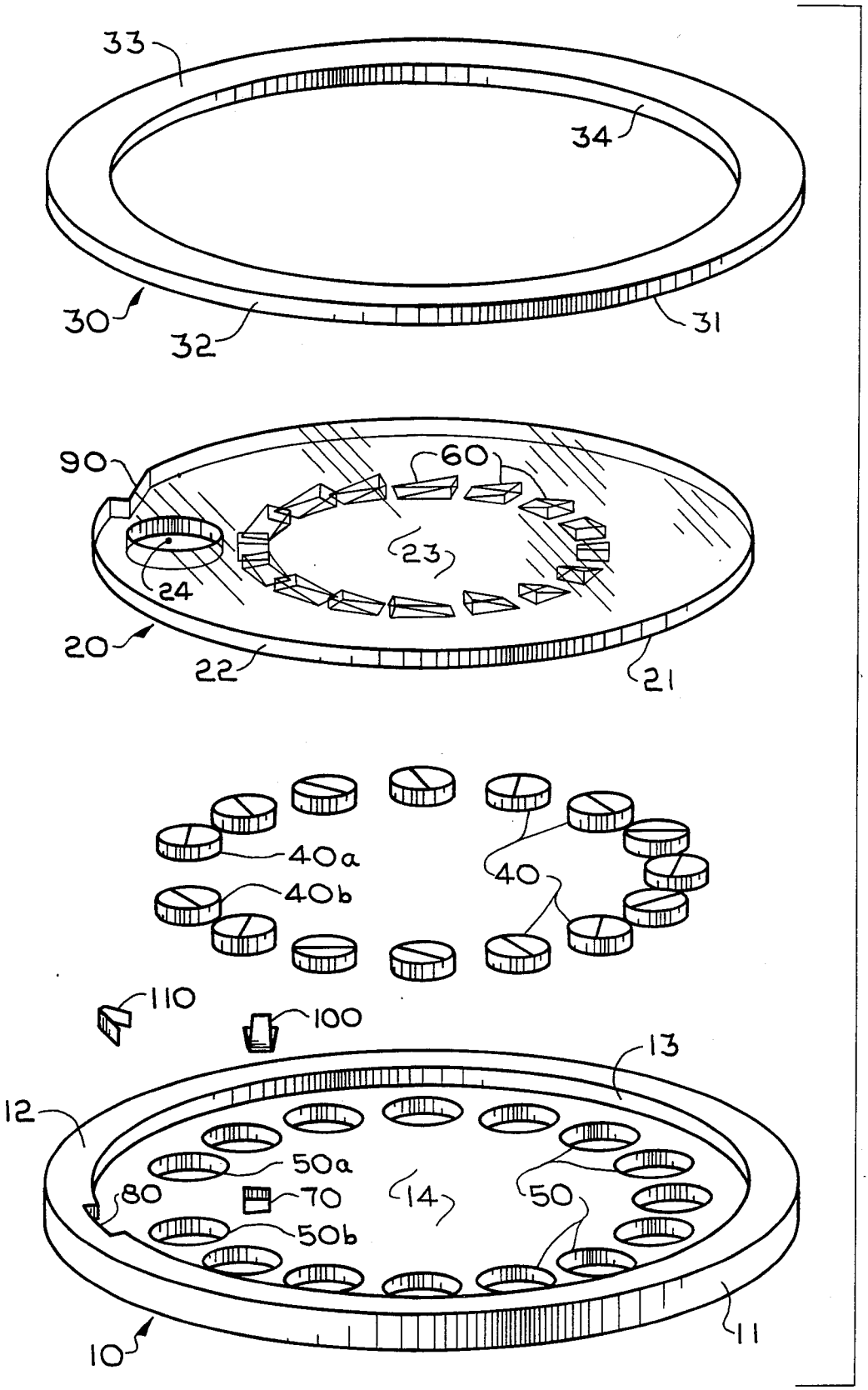
FIG. 1 is an exploded perspective view of the present invention.
Figure 2:
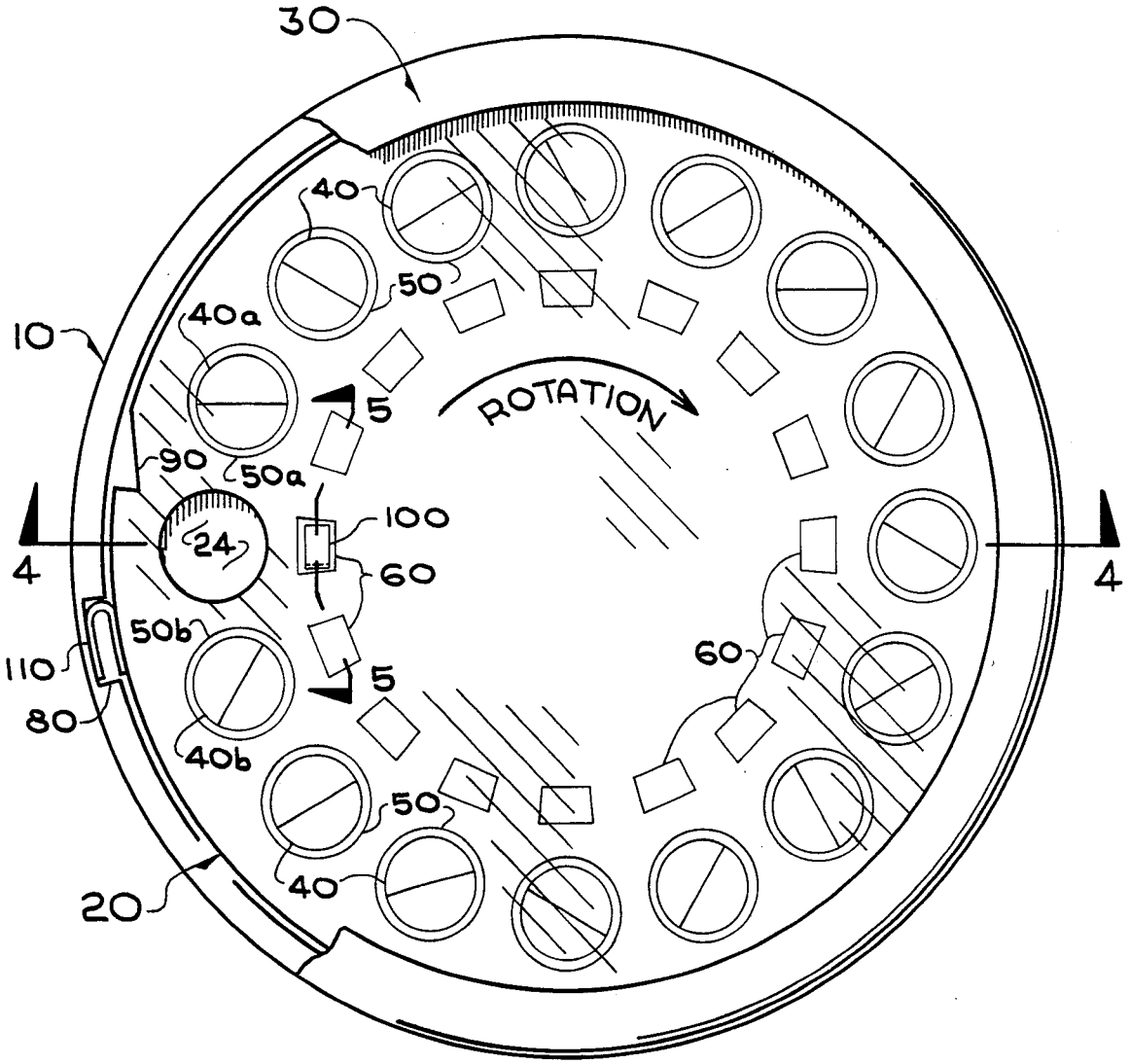
FIG. 2 is a plan view of the invention with a cut away section showing related parts.

Referring to the drawings the tamper-proof pill dispenser characterizing the present invention comprises a circular base 10 with an outside wall 11, a top surface 12, an inside wall 13 and a recessed surface 14. A plurality of pill seating depressions 50 are located within the outer perimeter of recessed surface 14. A spring seating depression 70 is also located into recessed surface 14. The inside wall 13 has a spring seating depression 80 located into its surface. Pawl spring 100 is housed into spring seating depression 70 and pawl spring 110 is housed into spring seating depression 80. The pills 40 are housed into the pill seating depressions 50. A circular cover 20 made of a transparent material is comprised of a bottom surfce 21 , a side wall 22 and a top surface 23. The cover 20 has a dispensing hole 24 that runs through both the top surface 23 and through the bottom surface 21. A sawtooth notch 90 is cut into side wall 22 and a plurality of sawtooth notches 60 arranged in a circular formation are cut into bottom surface 21. A retaining member 30 comprises a bottom surface 31, an outside wall 32, a top surface 33 and an inside wall 34.

The order of assembly of the pill dispenser is illustrated in FIG. 1. First, the pills 40, 40*a* and 40*b* are placed into the pill seating depressions 50, 50*a* and 50*b* in the base 10. The first pill 40*a* is placed into pill seating depression 50*a*, the last pill 40*b* is placed into pill seating depression 50*b*, and the remaining pills 40 are placed into the remaining pill seating depressions 50. Next, the pawl springs 100 and 110 are placed into the spring seating depressions 70 and 80 in base 10. Next, the cover 20 is placed within inside wall 13 of base 10, with the dispensing hole 24 positioned between the first pill 40*a* and the last pill 40*b*. Finally the bottom surface 31 of the retaining member 30 is mounted to the top surface 12 of base 10. This mounting may be accomplished by any means which will allow for a permanent bond between the top surface 12 of base 10 and the bottom surface 31 of retaining member 30. The pill dispenser is now fully loaded with pills, sealed closed and ready to be used.

Figure 5:
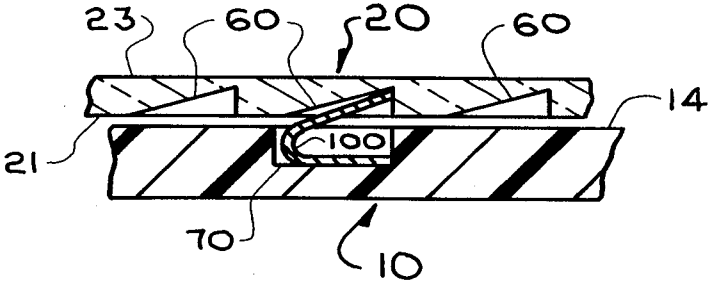
FIG. 5 is a sectional view of the present invention taken along line 5—5 of FIG. 2.

FIG. 5 shows a cross section of the pill dispenser with pawl spring 100 sprung into one of the sawtooth notches 60 located in the underside surface 21 of cover 20.

Figure 4:
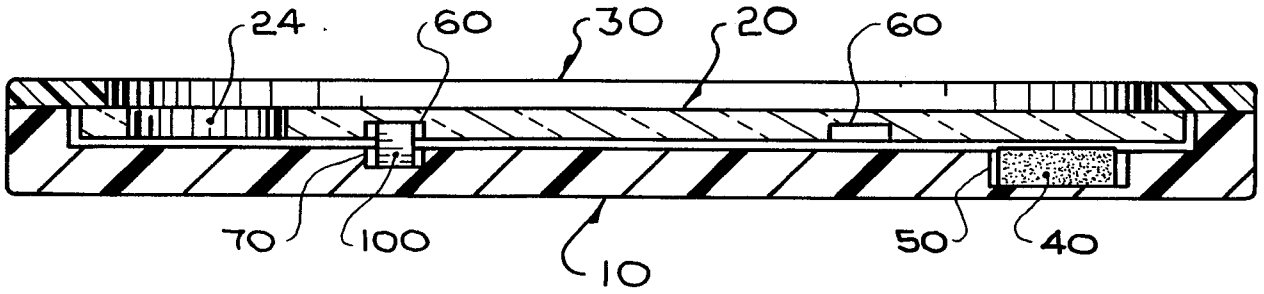
FIG. 4 is a sectional view of the present invention taken along line 4—4 of FIG. 2.

FIG. 4 shows a cross section taken completely through the pill dispenser with dispenser in unused status.

Figure 3:
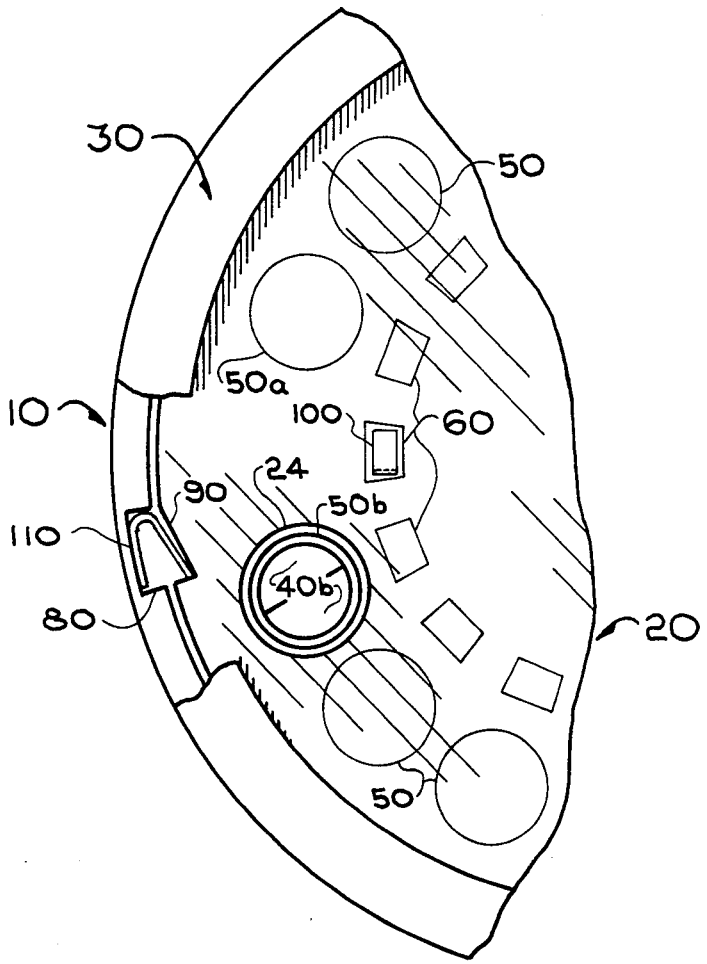
FIG. 3 is a part plan view of the invention with a cut away section showing related parts.

To release pills from the dispenser rotate cover 20 in a clockwise direction (pawl spring 100 prohibits counterclockwise rotation of cover 20) until pawl spring 100 snaps into the next in line sawtooth notch 60. At this time the dispensing hole 24 will be positioned directly over the first pill 40*a*. By placing one hand over the dispensing hole 24 and then turning the pill dispenser upside down the first pill 40*a* will fall through the dispensing hole 24 and into hand. Until the next pill is required leave cover 20 at its present position. When the next pill is needed repeat the sequence just stated and continue to repeat sequence as pills are needed until all the pills have been used up. Once the dispensing hole 24 is rotated over the last pill 40*b* (see FIG. 3) pawl spring 110 snaps into sawtooth notch 90 and cover 20 is locked from any further movement. After the last pill 40*b* is removed through the dispensing hole 24 the dispenser is no longer useable.

Having thus described the invention, it is to be understood that certain modifications in the construction and arrangement of the parts thereof will be made, as deemed necessary, without departing from the scope of the appended claims,

I claim:

1. A tamper-proof pill dispenser comprising:

a base having means for holding pills in a plurality of serial positions in generally circular arrangement;

a cover supported above said base for rotary motion and including a dispensing hole through which pills are dispensed;

attachment means for affixing said cover to said base while permitting rotary motion of said cover with respect to said base; and stop means for permitting rotation of said cover with respect to said base in only one direction to place said dispensing hole in serial register with the serial positions and for preventing further rotation of said cover in either direction after said dispensing hole has been placed in register with the last serial position.

2. A tamper-proof pill dispenser in accordance with claim 1 wherein said stop means includes a first pawl attached to one of said base and cover cooperating with a plurality of first notches formed in the other of said base and cover to permit rotation of said cover in only one direction, and a second pawl attached to one of said base and cover cooperating with a second notch formed in the other of said base and cover to prevent further rotation of said cover in either direction after said dispensing hole has been placed in register with the last serial position.

3. A tamper-proof pill dispenser in accordance with claim 1 wherein said attachment means permanently affixes said cover to said base.

4. A tamper-proof pill dispenser comprising:

a base having a wall extending about its perimeter and a recessed surface located within said wall, said wall having a top surface and a cylindrical inside surface;

a plurality of pill seating depression formed in a circular arrangement in said recessed surface;

a cover supported above the recessed surface of said base for rotary motion, said cover having a circular perimeter surface for sliding engagement with the inside surface of said wall and a dispensing hole alignable with said pill seating depressions;

a retaining member attached to said base for permanently securing said cover to said base while permitting rotary motion of said cover with respect to said base;

a plurality of first notches in a sawtooth shape formed in a surface of said cover facing said recessed surface of said base and arranged in a circular pattern, a first pawl spring secured to said base in alignment with said first notches, said first pawl spring and first notches being arranged to co-operate with one another to permit rotation of said cover in only one direction and to place said dispensing hole in serial alignment with said pill seating depressions;

a second notch formed in said cover, a second pawl spring secured to said base, said second notch and second pawl spring being arranged to prevent further rotation of said cover in either direction after said dispensing hole has been aligned with the last pill seating depression.

5. A tamper-proof pill dispenser in accordance with claim 4 wherein said second pawl spring is held in a third notch formed in the inner surface of said wall and said second notch is formed in the perimeter surface of said cover.

6. A tamper-proof pill dispenser in accordance with claim 4 wherein said first notches and said first pawl spring are located radially inward of said pill seating depressions.

7. A tamper-proof pill dispenser in accordance with claim 6 wherein said first notches are formed in the surface of said cover facing said recessed surface, and said first pawl spring is secured to said base.

8. A tamper-proof pill dispenser in accordance with claim 4 wherein said retaining member is comprised of a ring attached to the top surface of said wall.

* * * * *